US006990986B2

(12) United States Patent
Valentini

(10) Patent No.: US 6,990,986 B2
(45) Date of Patent: Jan. 31, 2006

(54) HAIR CURLING DEVICE

(76) Inventor: Rudolfo Valentini, 12 Augustus Road, Wimbledon Park, London SW19 6LN (GB)

( * ) Notice: Subject to any disclaimer, the term of this patent is extended or adjusted under 35 U.S.C. 154(b) by 37 days.

(21) Appl. No.: 10/258,271

(22) PCT Filed: Apr. 25, 2001

(86) PCT No.: PCT/GB01/01835

§ 371 (c)(1),
(2), (4) Date: Oct. 22, 2002

(87) PCT Pub. No.: WO01/80682

PCT Pub. Date: Nov. 1, 2001

(65) Prior Publication Data

US 2003/0102006 A1 Jun. 5, 2003

(30) Foreign Application Priority Data

Apr. 27, 2000 (GB) ..... 0010269

(51) Int. Cl.
*A45D 2/00* (2006.01)

(52) U.S. Cl. ..... 132/245; 132/226

(58) Field of Classification Search ..... 132/207, 132/210, 222, 226, 243, 245, 246, 247, 248, 132/250, 254, 267, 55; 2/21, 163; D28/10
See application file for complete search history.

(56) References Cited

U.S. PATENT DOCUMENTS 1,619,743 A * 3/1927 McClaire ..... 132/246
2,157,293 A * 5/1939 Lenta ..... 2/21
2,207,672 A * 7/1940 Levey ..... 223/101
2,386,612 A * 10/1945 Johnson ..... 132/248
2,452,225 A * 10/1948 Coloccia ..... 132/247
2,525,981 A * 10/1950 Webster ..... 132/246
2,528,994 A * 11/1950 Beguhn ..... 132/247
2,625,941 A * 1/1953 Harrington ..... 132/250
2,636,492 A * 4/1953 Wright ..... 602/61
2,637,031 A * 5/1953 Friedman ..... 2/21

(Continued)

FOREIGN PATENT DOCUMENTS

GB 2 277 026 10/1994

*Primary Examiner*—Eduardo C. Robert
*Assistant Examiner*—David Comstock
(74) *Attorney, Agent, or Firm*—Arnold B. Silverman; William F. Lang, IV; Eckert Seamans Cherin & Mellott, LLC

(57) ABSTRACT

A hair curler suitable for retaining curls of hair and allowing the administration of hair treatment products to the hair curls while in their retained position, comprising a permeable elastic tube (10) open at one end (10*b*), the open end and a circumferential region (14) of the tube intermediate the ends being either of a smaller diameter or higher modulus of elasticity than the major part of the tube. The hairdresser draws the tube (10) over his or her forefinger and winds the hair around the portion of the tube (10) between the end (10*a*) and the waist (14). Once fully wound, the open end (10*b*) is drawn "inside out" to secure the curl in place, without the need for the hairdresser to apply any manual gripping action. The permeability of the tube allows the administration of hair treatment products while the curl is in the secured position and, when treatment has finished, the tube is easily removed by drawing the rim (16) of the open end (10*b*) back over the treated hair curl.

7 Claims, 3 Drawing Sheets

U.S. PATENT DOCUMENTS 2,888,019 A * 5/1959 Whitmore ..... 132/247
3,263,682 A * 8/1966 Rosenfield ..... 602/63
3,307,562 A * 3/1967 Corbett et al. ..... 132/245
3,693,637 A * 9/1972 Sidelman ..... 132/55
3,727,659 A * 4/1973 Shuford ..... 150/160
4,127,222 A * 11/1978 Adams ..... 223/101
4,239,134 A * 12/1980 Joy ..... 223/101
4,534,066 A * 8/1985 Hansson ..... 2/163
4,733,410 A * 3/1988 Glotkin ..... 2/21
4,751,747 A * 6/1988 Banks et al. ..... 2/21
4,926,851 A * 5/1990 Bulley ..... 602/60
4,944,437 A * 7/1990 Calvert ..... 223/101
5,303,723 A * 4/1994 Schach ..... 132/246
5,367,711 A * 11/1994 Calagui ..... 2/161.6
5,472,003 A * 12/1995 Frame et al. ..... 132/275
5,711,324 A 1/1998 Johnson et al.
5,761,743 A * 6/1998 Andrews et al. ..... 2/21
5,954,245 A * 9/1999 Kluesner ..... 223/101
6,307,118 B1 * 10/2001 Reich ..... 602/42

* cited by examiner

HAIR CURLING DEVICE

DESCRIPTION OF INVENTION

THIS INVENTION relates to a hair curler and it is an object of the invention to provide an improved hair curler.

GB 2277026 discloses a hair curler in the form of a pocket or "sock" of stretchable stocking fabric which, during hair treatment, can provide an intrusion to extend within the coil of a coiled lock of hair and can also contain the coil on its exterior.

It is an object of the invention to provide an improved hair curler utilising the same general principles as that of GB 2277026.

According to the invention there is provided a hair curler comprising a permeable elastic tube which is closed at one end and open at the other and wherein said free end and a circumferential region of the tube intermediate said free end and said open end are either of smaller diameter than the remainder of the tube in an unstressed condition of the latter, or have a higher modulus of elasticity than the remainder of said tube, or both.

In a preferred embodiment of the invention the closed end of the tube is less permeable to fluid than the remainder.

The closed end of the tube may have a gripping tab adapted, to be grasped between finger and thumb.

Figure 1:
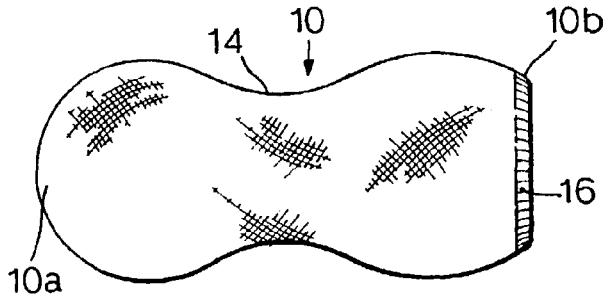
Figure 2:
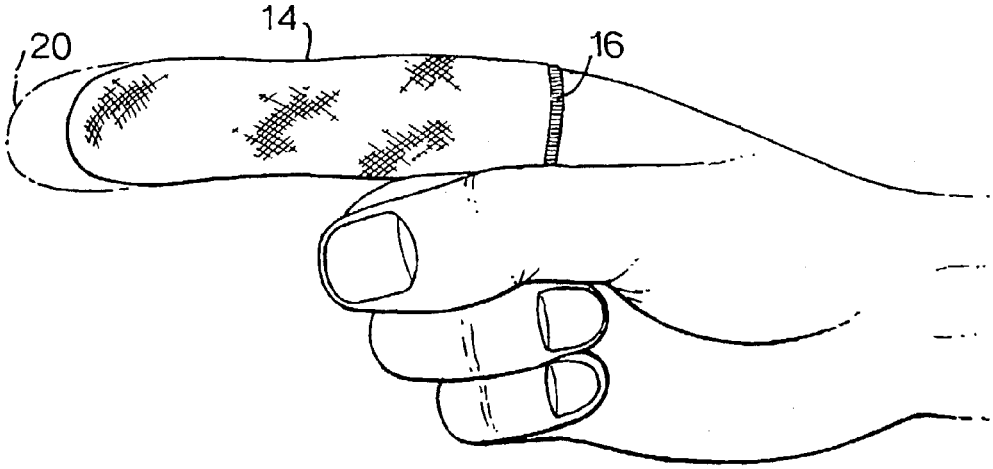
Figure 3:
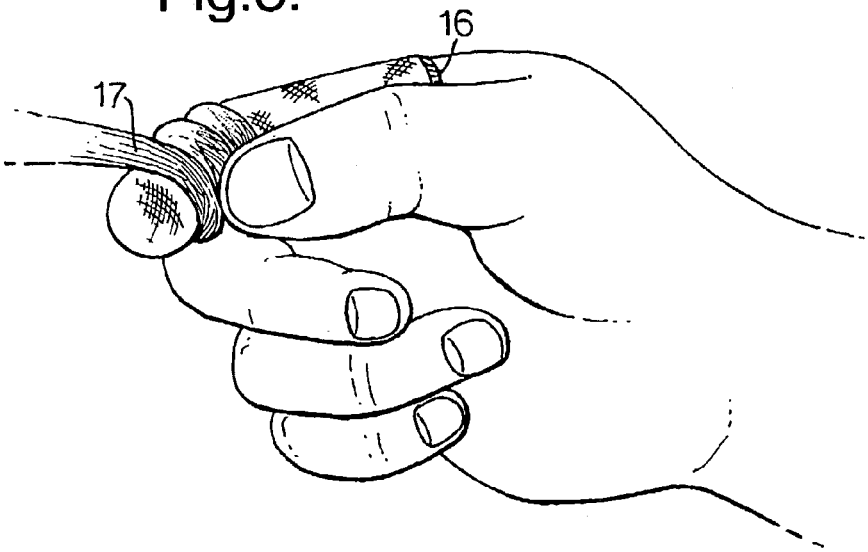
Figure 4:
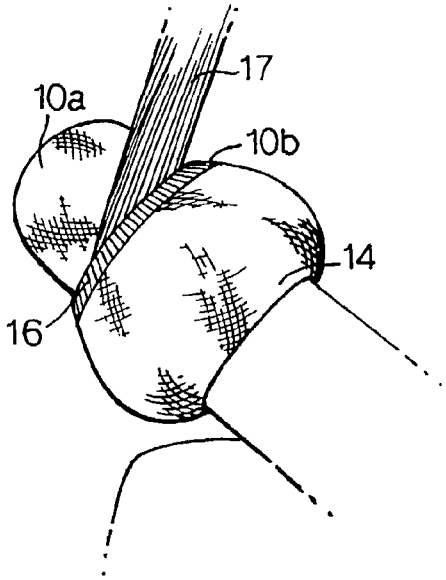
Figure 5:
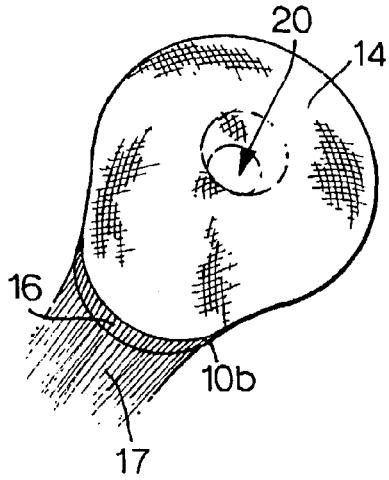
Figure 6:
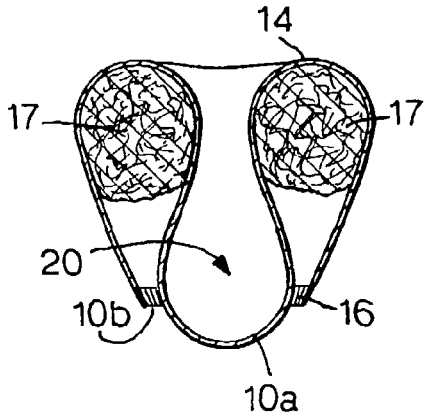
Figure 7:
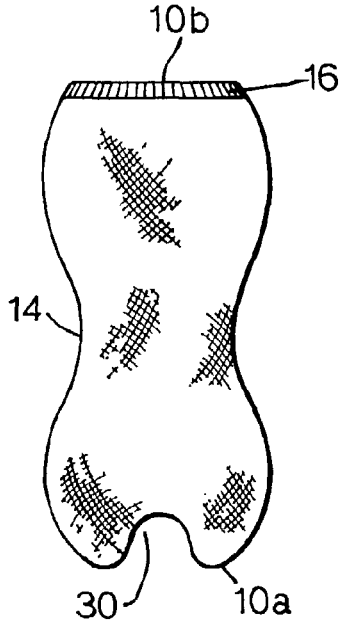
Figure 8:
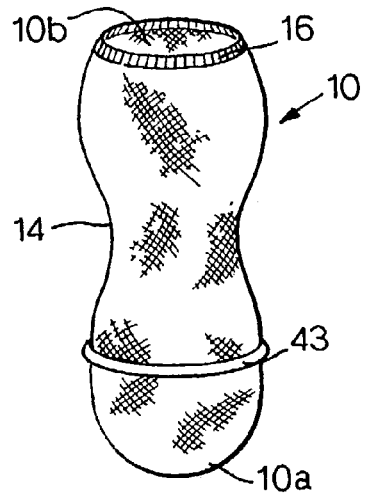
Figure 9:
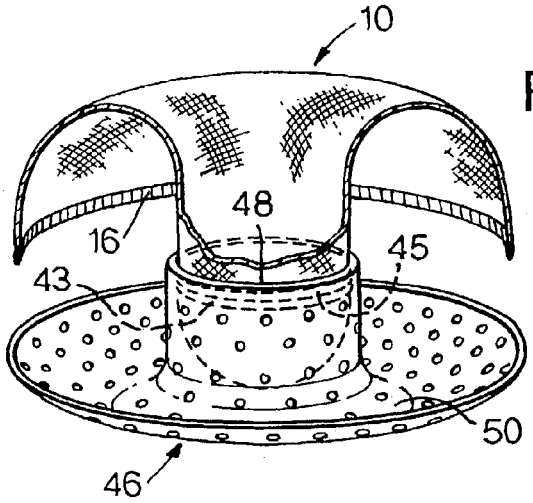
Figure 10:
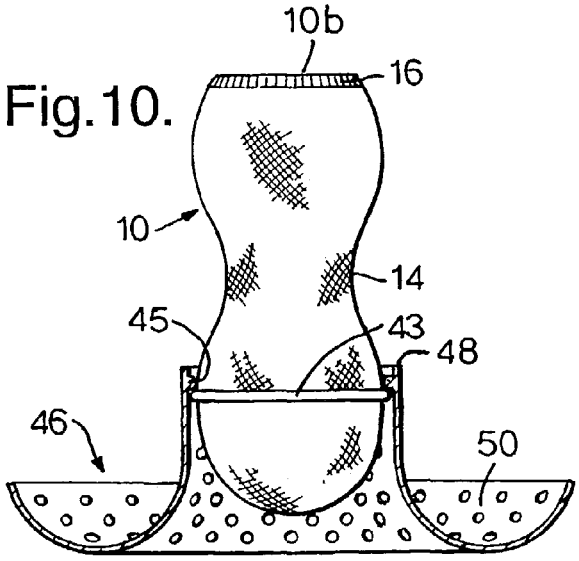

An embodiment of the invention is described below with reference to the accompanying drawings, in which:

FIG. 1 is a plan view of a hair curling device in accordance with the invention, in a flattened condition, FIG. 2 is a perspective view showing the hair curling device in use fitted over a hairdresser's finger, in a first phase of such use, FIG. 3 is a perspective view similar to FIG. 2, but showing a strand of hair being wound around the curling device supported on a hairdresser's finger, in a second phase, FIGS. 4 and 5 are fragmentary perspective views illustrating further phases in use of the hair curling device, FIG. 6 is a schematic sectional view illustrating the function of the device of FIGS. 1 to 5, FIG. 7 is a side view of a variant hair curler, FIG. 8 is a side view of a further variant, FIG. 9 is a perspective view, partly cut away, of the curler of FIG. 8 in use in conjunction with an ancillary device, and FIG. 10 is an axial section view of the arrangement of FIG. 9.

Referring to the drawings, a hair curler comprises a tube 10 of stretchable fabric closed at one end 10*a* and open at its other end 10*b*. The fabric may, for example, be knitted from a stretchable yarn, such as that supplied under the Registered Trade Mark "Lycra" and, for example, may be knitted in tubular fashion, in one piece, by a circular knitting machine, in manner known per se for stockings, etc. The tube 10 is in any case, at least over most of its length, of an open mesh fabric to allow ready penetration, in use, by hair setting solutions or other hair-treating liquids.

Alternatively the tube 10 may be formed of an elastomeric film, rather than a woven or knitted yarn, with the desired porosity being obtained by forming holes through the elastomeric material in selected regions. This may facilitate the provision of different porosities in different regions of the device (see below).

In one form, the tube 10 is so formed that, in a flattened condition, in an unstressed state, it has the configuration shown in FIG. 1, having a narrowing or waist 14, approximately midway between its ends, the tube similarly having a narrowing or neck 16 at its open end 10*b*. Thus in the preferred embodiment, the tube 10 may be, in its unstretched condition, of substantially constant circumference over its length, except over the regions 14 and 16.

In use of the curler, the hairdresser draws the tube 10 over his or her forefinger as illustrated in FIG. 2, so that the waisted region 14, and also the neck region 16, grip the finger more firmly than the remaining parts of the device, due to their being stretched more in order to fit the finger. It will be understood that these regions nevertheless grip the hairdresser's finger relatively lightly, albeit more firmly than other regions. As shown in FIG. 3, a strand of hair 17, typically a twisted strand of damp hair, is then wound around the portion of the tube 10 between the end 10*a* and the waist 14, whilst this portion of the tube is supported internally by the hairdresser's finger. The tightness of curl can be chosen by the hairdresser, ranging from a very tight wind to a loose rolling or to complex spirals, etc. When the strand of hair has been fully wound around the fabric tube 10 in this fashion, the loose end of the hair is retained with the thumb of the hand around the index finger of which the curler is fitted and the open end 10*b* of the tube is gripped by the hairdresser's hand or other hand and is drawn in an "inside out" or inverted condition over the coil of hair wound around the portion of the tube 10 between the free end 10*a* and waist 14, as illustrated in FIG. 4, so that the strand of hair in a coiled condition is securely located between the portion of the tube between the end 10*a* and waist 14, (which portion is disposed radially inwardly of the coil of hair), and the inverted tube portion between the waist 14 and open end 10*b*, the latter portion being now extended around the outside of the curl. The elastic neck 16 of this outer tube portion contracts inwardly when released and thus holds the curl of hair securely in place after the hairdresser's finger is withdrawn from the device as illustrated in perspective in FIG. 5 and in "axial" section in FIG. 6. By way of example, a hair treatment lotion may be dispensed into the space 20, previously occupied by the hairdresser's finger, within the region of the tube surrounded by the coil of hair, (surrounded in turn by the part of the device between the neck 16 and the waist 14). Successive treatment fluids, or rinsing water, may likewise be directed into the interior of the part of the device 10 around which the coil of hair is wound.

After the hair has been treated, e.g. after the curl has been set in manner known per se, the curler 10 can readily be removed by pulling the neck portion 16, for example, so that the outer portion, (adjacent the neck 16) of the tube 10 is peeled off the formed curl and the underlying inner portion of the curler. If desired, the closed end 10*a* of the tube 10 may be furnished with a gripping tab 20 (shown in broken lines in FIG. 2), which can be held with one hand whilst the neck 16 is pulled off the formed curl with the other.

In the condition illustrated in FIGS. 5 and 6, the part of the device lying between the neck 16 and waist 14 is, in effect, stretched over the coil of hair within, the tension in the device due to such stretching being counteracted by the natural elasticity of the coiled hair, (which naturally tends to uncoil), and the neck 16 tends to contract resiliently inwardly, below the coil of hair (as viewed in FIG. 6) to retain the coil of hair in place. Preferably, the portion of the tube 10 between closed end 10*a* and waist 14 is knitted, or otherwise formed, (for example knitted with longitudinal ribs), in such a way as to be somewhat resistant to (radially) inward compression, so as to assist in resisting any inward collapse of the coil of hair 17. Furthermore, the closed end 10*a* may be so formed as to be of a denser and less permeable weave or knit so as to resist the passage of hair treatment lotion through the bottom of the cavity defined by the portion of the device in the interior of the coil of hair and thus to enhance the tendency of such lotion to pass (radially) through the permeable wall portion (between end 10*a* and waist 14) into the coil of hair 17. Either or both of these features may, for example, be achieved, or enhanced, by selective impregnation of the knitted or woven fabric in the respective areas with an elastomeric resin, (with holes being formed through the material, to maintain the desired porosity, in regions where stiffness coupled with porosity is desired). Alternatively, selective relative stiffness and resistance to compression may be achieved by incorporating a reinforcement of plastics or even wire mesh into the respective region of the component. Other means known to those skilled in the art of securing selective stiffening and/or variation in permeability in selected areas of the device may, of course, be used.

Where the portion of the device between the closed end and the region 14 is rendered sufficiently stiff, it may be practicable to form the closed end with a notch or indentation, as illustrated at 30 in FIG. 7, to receive the portion of the strand 17 of hair being curled, extending from the confines of the enveloping portion, (in the phase illustrated in FIGS. 5 and 6) to thereby provide additional retention.

It will be understood that whilst, in the embodiment described, the tube 10 is waisted at 14 and narrowed at 16 so that, in use, it will be "tighter" at these locations than elsewhere, the same purpose can be met in other ways. For example, the tube 10 may, in an unstressed condition, be of uniform diameter throughout its length, but the middle and open end regions 14 and 16 may have a higher modulus of elasticity, for example, as a result of being provided with additional elastic yarn or elastic reinforcement, than the remainder of the device, so that the remainder of the device will stretch more readily than these regions. The open end or neck 16 of tube 10, in particular, is preferably provided with some elastic reinforcement, as it is important for the functioning of the device that this region should retain its resilience in use. Furthermore, since the portion of the device between closed end 10*a* and the waist region 14 need not undergo significant stretching, this portion might be formed to resist inward compression, whilst still having the necessary porosity, rather than being formed for elasticity, if manufacture of the device so as to have such different characteristics in different regions thereof is practicable.

Referring to FIGS. 8 to 10, an ancillary member 46, (FIGS. 9 and 10), may be used in conjunction with a variant of the device of FIGS. 1 to 6 (shown in FIG. 8) to allow the hairdresser more easily to control the form and size of a curl. In this arrangement, the tube 10 has, adjacent its closed end, as shown in FIG. 8, a relatively stiff circumferential band or hoop 43, for example of rigid plastics or of plastics-coated or rubber-coated wire, for a purpose explained below.

As shown in FIG. 9, the ancillary member 46 is an annular member which conveniently takes the form of part of a notional toroidal shell providing an approximately tubular collar 48 from which extends downwardly, (in the orientation shown in FIG. 9), a flaring skirt or flange 50. In use, the tube 10 is inserted in the open "bottom" end of the member 46 and is drawn, open end 10*b* first, upwardly through the collar 48 until the rib or hoop 43 lodges firmly within the collar 48 against an internal circumferential locating rib 45 in the collar 48 so that the tube 10 and member 46 are thereafter frictionally connected until the tube 10 is extracted from the member 46 by reversal of the procedure described. (Purely for illustrative purposes, the tube 10 is shown only partially in FIG. 9 and is shown in the configuration it will adopt around a curl of hair). The member 46 may again be made of a stiff porous material, for example, metal gauze, or may be of stiff plastics with holes formed therethrough as indicated.

In the arrangement of FIGS. 9 and 10, the elasticated tube 10 may be, in effect, a disposable item, the member 46 being re-used whilst the tube 10 is discarded after use and replaced by a new tube 10. Members 46 in different sizes may be provided to assist the hairdresser in ensuring a desired eventual curl size.

In the present specification "comprises" means "includes or consists of" and "comprising" means "including or consisting of".

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A hair curler comprising a permeable elastic tube which is open at a first end thereof and wherein said first end and a circumferential region of the tube intermediate the ends of said tube are either of smaller diameter than the major part of the tube in an unstressed condition of the latter, or have a higher modulus of elasticity than the major part of said tube, or both, and wherein the end of said tube opposite said first end is closed and is less permeable to fluid than the remainder of the curler, and wherein the major part of the tube is located on both sides of the intermediate circumferential region having either a smaller diameter than the major part of the tube or a higher modulus of elasticity than the major part of the tube.

2. A hair curler comprising a permeable elastic tube which is open at a first end thereof and wherein said first end and a circumferential region of the tube intermediate the ends of said tube are either of smaller diameter than the major part of the tube in an unstressed condition of the latter, or have a higher modulus of elasticity than the major part of said tube, or both, wherein said tube is of an elastic fabric formed by weaving or knitting elastic yarn and wherein the end of said tube opposite said first end is closed and is less permeable to fluid than the remainder of the curler, and wherein the major part of the tube is located on both sides of the intermediate circumferential region having either a smaller diameter than the major part of the tube or a higher modulus of elasticity than the major part of the tube.

3. A hair curler comprising a permeable elastic tube which is open at a first end thereof and wherein said first end and a circumferential region of the tube intermediate the ends of said tube are either of smaller diameter than the major part of the tube in an unstressed condition of the latter, or have a higher modulus of elasticity than the major part of said tube, or both, and wherein said tube comprises an elastomeric film or wall rendered fluid permeable in selected regions by holes formed through such film or wall and the end of said tube opposite said first end is closed and is less permeable to fluid than the remainder of the curler, and wherein the major part of the tube is located on both sides of the intermediate circumferential region having either a smaller diameter than the major part of the tube or a higher modulus of elasticity than the major part of the tube.

4. A curler comprising a permeable elastic tube which is open at a first end thereof and wherein said first end and a circumferential region of the tube intermediate the ends of said tube are either of smaller diameter than the major part of the tube in an unstressed condition of the latter, or have a higher modulus of elasticity than the major part of said tube, or both, wherein said tube comprises an elastomeric film or wall rendered fluid permeable in selected regions by holes formed through such film or wall, and wherein the end of said tube opposite said first end is closed and has a gripping tab extending therefrom, and wherein the major part of the tube is located on both sides of the intermediate circumferential region having either a smaller diameter than the major part of the tube or a higher modulus of elasticity than the major part of the tube.

5. A curler comprising a permeable elastic tube which is open at a first end thereof and wherein said first end and a circumferential region of the tube intermediate the ends of said tube are either of smaller diameter than the major part of the tube in an unstressed condition of the latter, or have a higher modulus of elasticity than the major part of said tube, or both, wherein said tube is of an elastic fabric formed by weaving or knitting elastic yarn, and wherein the end of said tube opposite said first end is relatively stiff and is formed with a notch or indentation to receive a strand of hair extending from the curler in use, and wherein the major part of the tube is located on both sides of the intermediate circumferential region having either a smaller diameter than the major part of the tube or a higher modulus of elasticity than the major part of the tube.

6. A curler comprising a permeable elastic tube which is open at a first end thereof and wherein said first end and a circumferential region of the tube intermediate the ends of said tube are either of smaller diameter than the major part of the tube in an unstressed condition of the latter, or have a higher modulus of elasticity than the major part of said tube, or both, wherein said tube comprises an elastomeric film or wall rendered fluid permeable in selected regions by holes formed through such film or wall, and wherein the end of said tube opposite said first end is relatively stiff and is formed with a notch or indentation to receive a strand of hair extending from the curler in use, and wherein the major part of the tube is located on both sides of the intermediate circumferential region having either a smaller diameter than the major part of the tube or a higher modulus of elasticity than the major part of the tube.

7. A curler comprising a permeable elastic tube which is open at a first end thereof and wherein said first end and a circumferential region of the tube intermediate the ends of said tube are either of smaller diameter than the major part of the tube in an unstressed condition of the latter, or have a higher modulus of elasticity than the major part of said tube, or both, and said circumferential region has an outwardly projecting annular band, and wherein the major part of the tube is located on both sides of the intermediate circumferential region having either a smaller diameter than the major part of the tube or a higher modulus of elasticity than the major part of the tube.

* * * * *